US007258220B2

(12) United States Patent
Tezuka

(10) Patent No.: US 7,258,220 B2
(45) Date of Patent: Aug. 21, 2007

(54) TOKEN PURCHASING DEVICE

(75) Inventor: Kenichi Tezuka, Tokyo (JP)

(73) Assignee: Asahi Seiko Kabushiki Kaisha, Tokyo (JP)

( * ) Notice: Subject to any disclaimer, the term of this patent is extended or adjusted under 35 U.S.C. 154(b) by 558 days.

(21) Appl. No.: 10/666,585

(22) Filed: Sep. 18, 2003

(65) Prior Publication Data

US 2004/0124063 A1 Jul. 1, 2004

(30) Foreign Application Priority Data

Sep. 18, 2002 (JP) ..... 2002-272075

(51) Int. Cl.
*G07F 7/00* (2006.01)
*G07F 7/04* (2006.01)

(52) U.S. Cl. ..... 194/205; 194/206; 194/353

(58) Field of Classification Search ..... 194/205, 194/206, 302, 353; 221/2, 15, 206, 207; 235/7 A See application file for complete search history.

(56) References Cited

U.S. PATENT DOCUMENTS 3,165,185 A * 1/1965 Moore ..... 194/317
4,860,876 A * 8/1989 Moore et al. ..... 194/205
4,932,665 A 6/1990 Fejdasz et al.
5,366,110 A * 11/1994 Takemoto et al. ..... 221/2
5,533,727 A * 7/1996 DeMar ..... 463/23
5,547,192 A 8/1996 Ishibashi
5,645,486 A 7/1997 Nagao et al.
5,651,546 A 7/1997 Lawlor et al.
5,743,798 A 4/1998 Adams et al.
6,230,930 B1 * 5/2001 Sorensen et al. ..... 221/131
6,279,718 B1 * 8/2001 Nulph et al. ..... 194/206
6,283,268 B1 * 9/2001 Fletcher et al. ..... 194/344
6,659,259 B2 * 12/2003 Knox et al. ..... 194/217

* cited by examiner

*Primary Examiner*—Patrick Mackey
*Assistant Examiner*—Mark J. Beauchaine

(57) ABSTRACT

A token purchasing device that can automatically change the number of tokens purchased for a given price based on time, date, and day of the week information. The token purchasing device includes a banknote accepting unit for accepting a banknote and outputting a banknote value signal based on the denomination of the accepted banknote, a clock unit for outputting the current time and date information, a control unit for computing the number of tokens for dispensing, and a token dispensing unit. The control unit is configured to store a predetermined set of days or a range of times from a start time to an end time defining a special purchasing mode. The control unit can automatically change the number of tokens purchased when the current time and date is within the programmed parameters for the special purchasing mode.

8 Claims, 9 Drawing Sheets

TOKEN PURCHASING DEVICE

CROSS-REFERENCE TO RELATED APPLICATION

This application is based on an application number 2002-272075 filed in Japan, dated Sep. 18, 2002.

FIELD OF THE INVENTION

The present invention is related to banknote receiving and token dispensing device and more particularly to a banknote receiving and token dispensing device that can automatically dispense a different number of tokens based on the time of day and day of the week.

DESCRIPTION OF RELATED ART

Token purchasing devices are well known and have application in a wide variety of situations including gaming, gambling, and transportation. It is common for operators of establishments that use tokens to find the number of customers can vary considerably from day to day, and within any particular day. An accumulation of customers can lead to overcrowding and can create a less favorable atmosphere. Additionally, an operator may desire to increase the number of customers visiting on a less crowded day. For these reasons, it may be desirable to encourage customers to visit the establishment at times when the establishment is less crowded, and to increase customer visits during the less crowded periods.

One incentive to accomplish this purpose is to offer a special price for the tokens used in these establishments during off-peak customer times and days. Similarly, for a given price, an operator may offer more tokens to a customer during an off-peak time. By lowering the price of a quantity of tokens, or increasing the quantity of tokens for the same price, the operator can pull in more customers at particular times or on particular days. It is preferable to offer more tokens for a given price in order to keep the income from the token purchasing higher while putting more tokens into the hands of a customer, thereby encouraging more token use.

Previously, the process for changing the amount of tokens dispensed by a token purchasing device involved an inconvenient process of opening the token purchasing device and manually changing the dispensing quantity. This process may be multiplied for many token purchasing devices, creating a time consuming and costly burden for an operator. Additionally, this process of changing the amount of tokens dispensed may create an unsafe condition since customers can observe the operator during this process.

Accordingly, there is a need to provide an automatic way to change the number of tokens dispensed by a token purchasing device.

SUMMARY OF THE INVENTION

The present invention addresses the limitations of the prior art by providing a token purchasing device that can automatically dispense a different number of tokens based on the current time and date information for a given banknote value inserted into the token purchasing device. More particularly, the token purchasing device allows a user to purchase either a normal number of tokens in a normal purchasing mode, or a special, higher number of tokens in a special purchasing mode depending on predetermined date and time parameters compared with the current date and time.

The token purchasing device includes a box like chassis, a banknote accepting unit, a token dispensing unit, a control unit with a programming keypad, a change dispensing unit, a display unit, a touch screen unit, and a coin accepting unit. A user inserts a banknote into the banknote accepting unit. The banknote accepting unit asserts a banknote value signal to the control unit indicating the denomination of the bandicoot accepted. The control unit is programmed by entering time and date information on a keypad operatively connected to the control unit in order to define the time and date parameters of the special purchasing mode.

The display unit indicates whether the token purchasing device is currently in a normal purchasing mode or a special purchasing mode as well as indicating selection choices to the user. The display indicates the quantity of tokens for purchase based on a given banknote value. Once the user makes a selection, the control unit outputs a dispensing signal to the token dispensing unit. The number of tokens dispensed is counted until the process is completed. Any residual value from the banknote is refunded to the user by the coin dispensing unit.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the intention is intended to cover alternatives, modifications and equivalents, which may be included within the spirit and scope of the invention as defined by the appended claims.

Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

Figure 1:
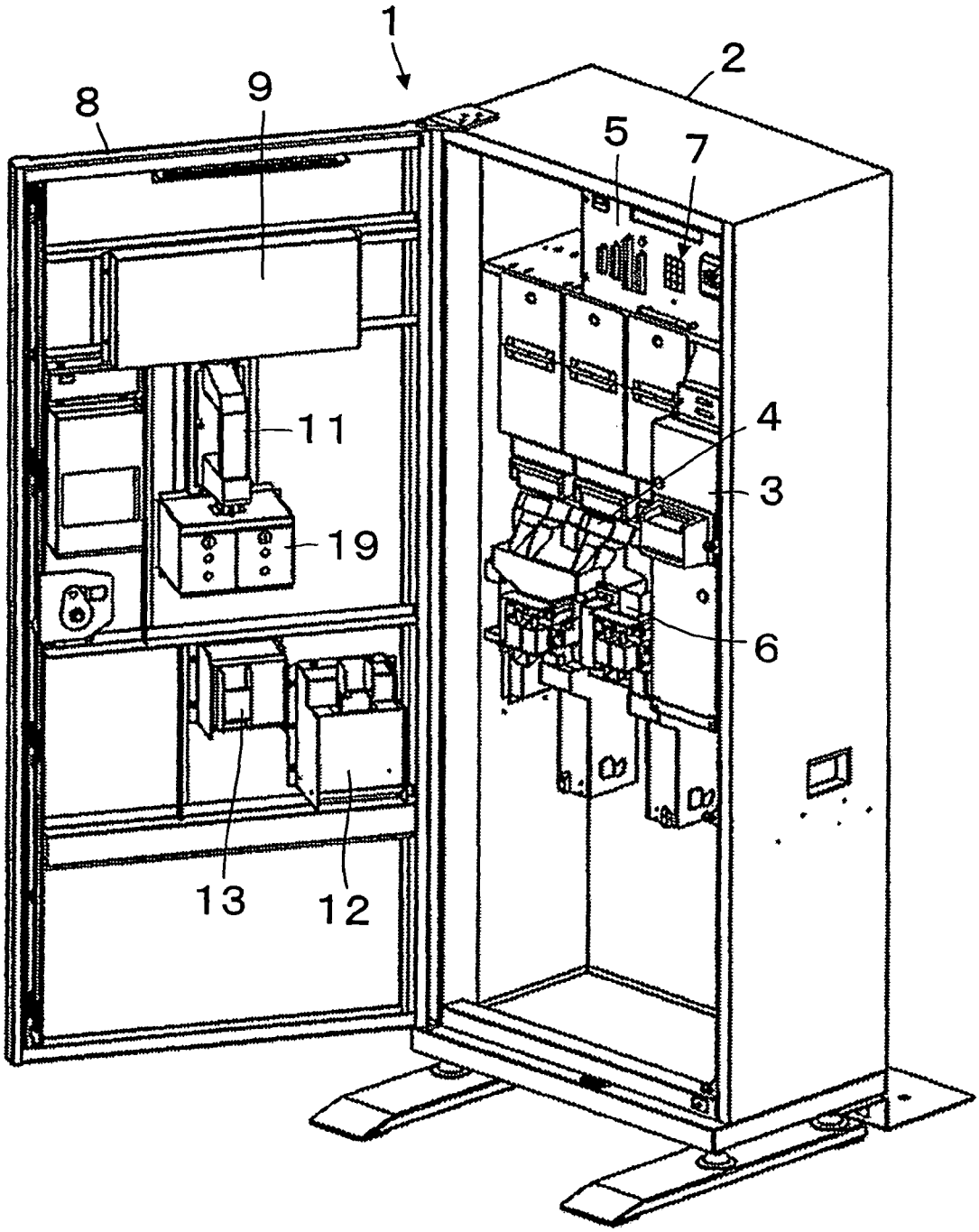
FIG. 1 shows a perspective view of a token purchasing device in an embodiment of the present invention. In this view, a chassis door is open on the chassis.

In reference to FIG. 1, the token purchasing device 1 allows a user insert a banknote that carries a value in order to purchase a quantity of tokens. The quantity of tokens purchased for value of the banknote can be either a normal number of tokens in a normal purchasing mode, or a special, higher number of tokens in a special purchasing mode depending on predetermined date and time factors compared with the current date and time. The special purchasing mode is provided in order to reward users for purchasing tokens on a particular date or at a particular time by giving the user more tokens for the same value of the banknote compared with the quantity of tokens purchased in the normal purchasing mode.

The token purchasing device 1 includes a box like chassis 2 within which is placed a banknote accepting unit 3, a token dispensing unit 4, a control unit 5, a change dispensing unit 6, a display unit 9, a touch screen unit 10, and a coin accepting unit 11. The chassis 2 has a rectangular shape and is closed by a chassis door 8 that is hingedly mounted on the chassis 2. The display unit 9 is mounted on the inside of the chassis door 8 opposite a window opening so that the display can be visible from outside the chassis 2.

The control unit 5 can receive signals from the banknote accepting unit 3, the touch screen 10, and the coin accepting unit 11. The control unit 5 can send signals to the token dispensing unit 4, the change dispensing unit 6, and the display unit 9. The control unit 5 is a processing unit for receiving signals and sending signals to operate an embodiment of the present invention. The control unit 5 performs calculations according to a stored program in order to send appropriate output signals to the display unit 9, the token dispensing unit 4, and the coin dispensing unit 6.

Figure 2:
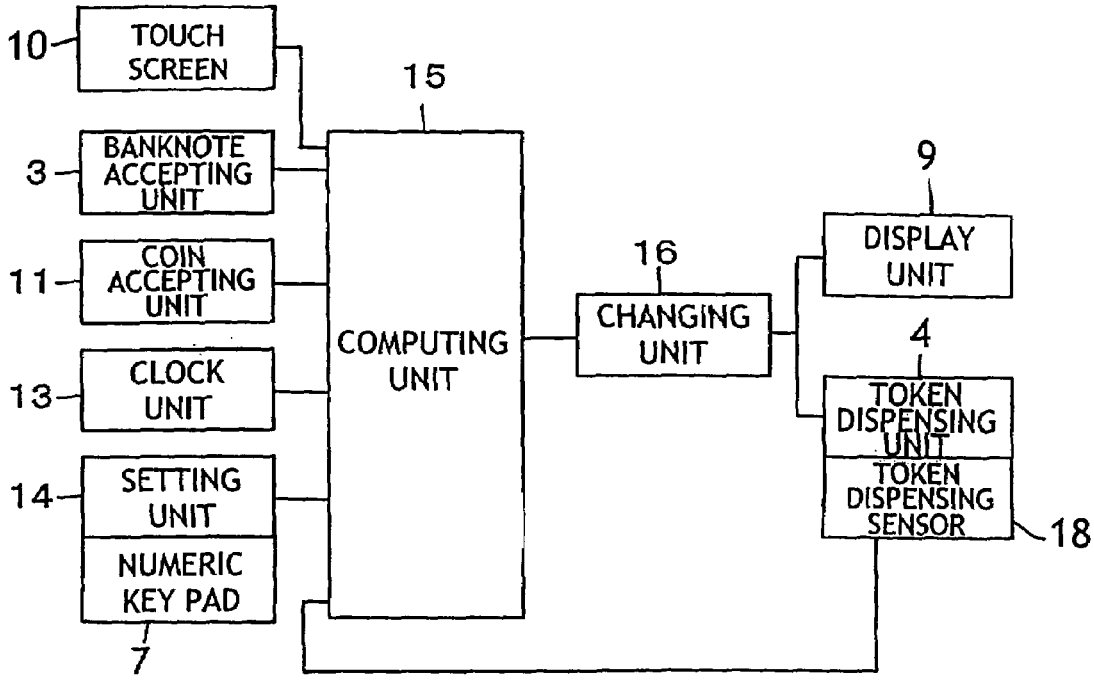
FIG. 2 is a block diagram of an embodiment of the present invention.

The control unit 5 includes a numeric keypad for use in programming the control unit 5. The connections between the units described supra are illustrated in block diagram form in FIG. 2. The sub-units of the control unit 5 are illustrated in block diagram form in FIG. 3.

The banknote accepting unit 3 accepts a banknote inserted by a user to purchase tokens. The banknote accepting unit 3 determines whether the accepted banknote is genuine or counterfeit. For a genuine banknote, the banknote accepting unit 3 determines the denomination of the accepted banknote and sends a banknote value signal to the control unit 5.

The banknote accepting unit 3 is mounted in the chassis 2 and positioned so that the input portion of the banknote accepting unit 3 can receive banknotes inserted through a banknote accepting opening in the chassis door 8 when the chassis door 8 is closed. Alternatively, the banknote accepting unit 3 can be mounted on the chassis door 8 and positioned so that banknotes can be inserted through the banknote accepting opening in the chassis door 8 and into the banknote accepting unit 3.

Accepted banknotes are stored in a storing section (not shown). The banknote accepting unit 3 can generally be called a currency accepting unit since it receives currency in the form of banknotes, depending on the location of use. The type of currency may be changed and adapted to the locally used currency and is not limited to YEN or DOLLAR as used in some examples infra.

Alternatively, the banknote accepting unit 3 may be replaced or supplemented by a magnetic card or smart card accepting unit. The card accepting unit can have the capability of reading from and writing to accepted cards, and then returning the cards to a user or receiving the cards to a storage section (not shown). The purpose of the banknote accepting unit 3 and any replacement or supplement is to present an article of value to the token purchasing device in order to purchase tokens.

Various mechanisms and sensors are known for determining whether a banknote is genuine or counterfeit, and accordingly are not included herein. In this specification, a banknote is a generic name that can include a note, folding money, a script, a check, a security bond, a coupon, a ticket, or other similar article that can be accepted and stored and that carries a value as indicated herein.

The token dispensing unit 4 has the function of reliably dispensing tokens one by one. In an alternative embodiment, tokens may be dispensed more than one by one. Part of the dispensing function can be to accurately count the dispensed tokens and to detect whether each dispensed token is genuine or counterfeit. The token dispensing unit 4 has a dispensing sensor 18 for detecting a dispensed token. The token dispensing unit 4 can also be called a token hopper 4 since the token dispensing unit 4 can retain a quantity of tokens in a container in preparation for dispensing.

A token can be a coin, a medallion, a pachinko ball, or other similar article that may be used in a gaming machine, transportation system, or other application where it is desirable to use an article of value that is not generally accepted for transactions outside of the specified application environment. A token can be distinguished from a coin in that a token may not be generally recognized a legal tender for public transactions.

The token dispensing unit 4 is mounted in the chassis 2 and positioned so that an output portion of the token dispensing unit 4, the portion where a dispensed token is ejected, is aligned with a token slot 12 mounted on the chassis door 8. The token slot 12 is mounted adjacent to an opening in the chassis door 8 so that a user may retrieve the dispensed token by reaching a hand into the token slot 12. The output portion of the token dispensing unit 4 and the token slot 12 are positioned when the chassis door 8 is closed so that a token ejected from the token dispensing unit 4 will fall into the token slot 12 and can be retrieved by a user.

Alternatively, the token dispensing unit 4 may be mounted on the chassis door 8 and positioned so that an ejected token will be conducted into the token slot 12. In another alternative, both the token dispensing unit 4 and the token slot 12 may be mounted in the chassis 2 with the opening of the token slot 12 being aligned with an opening in the chassis door 8. This description applies generally to other units of the present invention so described.

The coin accepting unit 11 accepts coins inserted by a user to purchase tokens. The coin accepting unit 11 determines whether the accepted coin is genuine or counterfeit. For a genuine coin, the coin accepting unit 11 determines the denomination of the accepted coin and sends a coin value signal to the control unit 5.

The coin accepting unit 11 is mounted on the chassis door 8 and positioned to receive coins inserted by a user through a coin accepting opening in the chassis door 8. Alternatively, the coin accepting unit 11 can be mounted in the chassis 2 and positioned so that coins can be inserted through the coin accepting opening in the chassis door 8 and into the coin accepting unit 11. Accepted coins are stored in a safe unit 19, as shown in FIG. 1.

The coin dispensing unit 6 is mounted in the chassis 2 and positioned so that an output portion of the coin dispensing unit 6, the portion where a dispensed coin is ejected, is aligned with a change slot 13 mounted on the chassis door 8. The change slot 13 is mounted adjacent to an opening in the chassis door 8 so that a user may retrieve the dispensed coin by reaching a hand into the coin slot 13. The output portion of the coin dispensing unit 6 and the coin slot 13 are positioned when the chassis door 8 is closed so that a coin ejected from the coin dispensing unit 6 will fall into the coin slot 13 and can be retrieved by a user.

Figure 4:
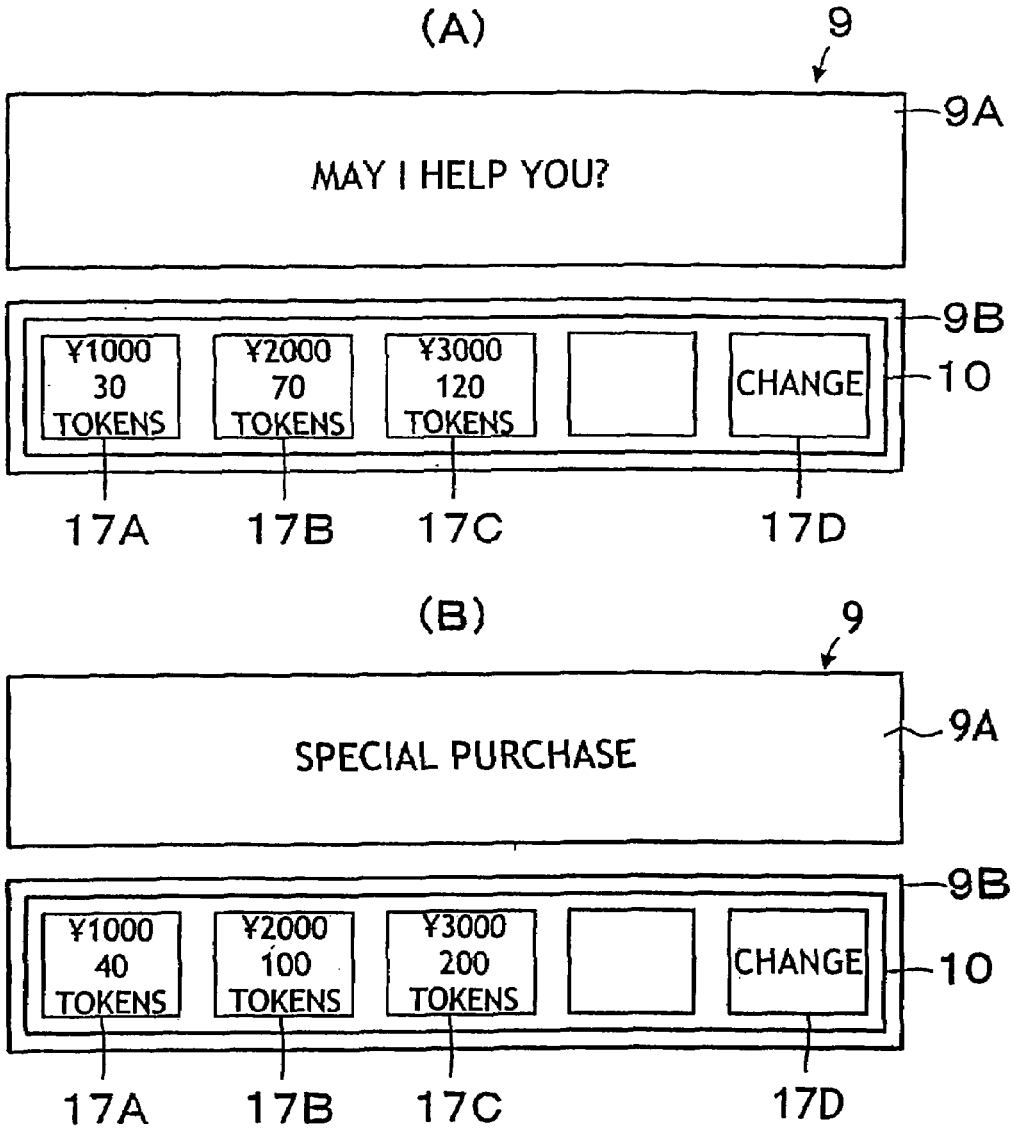
FIG. 4A is an example showing a configuration of the display and touch screen in a normal purchasing mode.
FIG. 4B is another example showing a configuration of the display and touch screen in a special purchasing mode.

The display unit 9 user interface can be a dot-matrix display, for example a liquid crystal display (LCD), a cathode ray tube (CRT), a fluorescent character display tube, a plasma display panel (PDP), or another display capable of displaying the token purchasing information as described herein. In the preferred embodiment, the display unit 9 includes a fluorescent character display tube 9A and 9B which are rectangular in shape and arranged vertically with display tube 9A above and display tube 9B below, as shown in FIGS. 4A-4B.

A touch screen 10 is located at a front face panel of the display unit 9 and is aligned with the fluorescent character display tube 9B. The touch screen 10 comprises a user interface and includes selecting buttons (17A, 17B, 17C, and 17D) corresponding to locations on the fluorescent display tube 9B for 1000 YEN 17A, 2000 YEN 17B, 3000 YEN 17C, and CHANGE 17D as shown in FIGS. 4A-4B and described in the flow chart of FIG. 6. The touch screen unit 10 is in a plane parallel to and overlapping a portion of the display unit 9B as shown in FIGS. 4A-4B.

The particular currency used such as YEN depends on the location of use. Alternatively, using dollars instead of YEN, the locations on the fluorescent display tube 9B can be defined to be 1 DOLLAR 17A, 5 DOLLARS 17B, and 10 DOLLARS 17C. Essentially, the buttons (17A, 17B, and 17C) correspond to different denominations or different value levels that a user may wish to use in order to purchase tokens. A greater or fewer number of buttons 17 may be present in an embodiment of the present invention, and the number of buttons in the preferred embodiment is not intended to be limiting.

It is common for a vendor to reward a buyer for buying a larger quantity of goods or services by either reducing the cost of the total purchase or by adding more goods or services for the same cost. In one example, if a user deposits a 1000 YEN banknote, the user may purchase 30 tokens. Second, if the user deposits a total of 2000 YEN, the user can purchase 70 tokens. Third, if a user deposits a total of 3000 YEN, the user can purchase 120 tokens. This illustrates a possible benefit of buying a larger quantity, and is one example of how an embodiment of the present invention can function in the standard purchasing mode.

If the user wishes to purchase a quantity of tokens whose value is less than the value of the banknote accepted, a difference between the value of the purchased tokens and the value of the inserted banknote is refunded to the user in the form of change from the coin dispensing unit 6.

In another example, an embodiment of the present invention at the special purchasing mode time can allow a user to purchase even more tokens for the same value of banknotes accepted. First, if a user deposits a 1000 YEN banknote, the user may purchase 40 tokens. Second, if the user deposits a total of 2000 YEN, the user can purchase 100 tokens. Third, if a user deposits a total of 3000 YEN, the user can purchase 200 tokens. This illustrates the benefits of buying a larger quantity, and is one example of an embodiment of how the present invention can function in the special purchasing mode.

The banknote accepting unit 3, the coin accepting unit 11, a clock unit 13, and a setting unit 14 are connected to input terminals of a computing unit 15. The clock unit 13 has a calendar function with a built in clock to keep track of the time of day. The clock unit 13 outputs the date, time, day, and day of the week information to the computing unit 15.

The setting unit 14 can be programmed with a plurality of group settings which include a day of the week and time information by the numeric keypad 7. These group settings can indicate a plurality of special purchasing mode dates and times when a user can purchase tokens and receive the special purchasing mode benefit of more tokens. The group settings include a start time and end time comprising a range of times for a particular special purchasing mode.

The computing unit 15 can modify the changing unit 16 based on the banknote value signal from the banknote accepting unit 3, the coin value signal from the coin accepting unit 11, and the day of the week and the time from the clock unit 13. The changing unit 16 changes the display of the display unit 9 corresponding to set the day of the week and the time which are programmed in the setting unit 14. The dispensing quantity for the token dispensing unit 4 is set to the programmed quantity.

Figure 3:
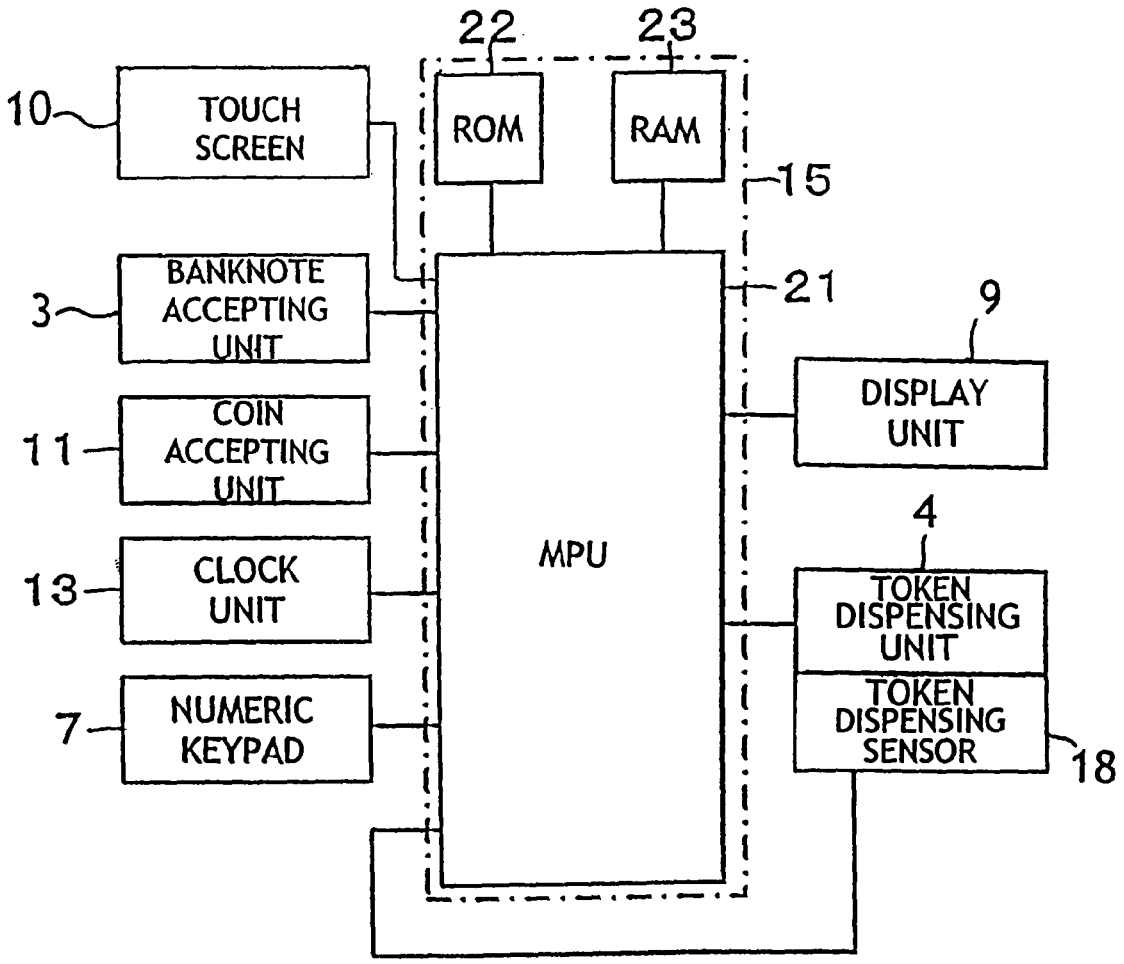
FIG. 3 is a block diagram of the control unit of an embodiment of the present invention.

In one embodiment, the control unit includes a microprocessor unit (MPU) 21, as shown in FIG. 3. In this case, the computing unit 15 includes the microprocessor unit 21, a read only memory (ROM) unit 22 for storing a predetermined program, and a random access memory (RAM) unit 23. The setting unit 14 and the changing unit 16 are implemented using the predetermined program to operate on the parameters entered by a technician using the numeric keypad 7 to initialize the setting unit 14 prior to operation of the token purchasing device 1.

Figure 5:
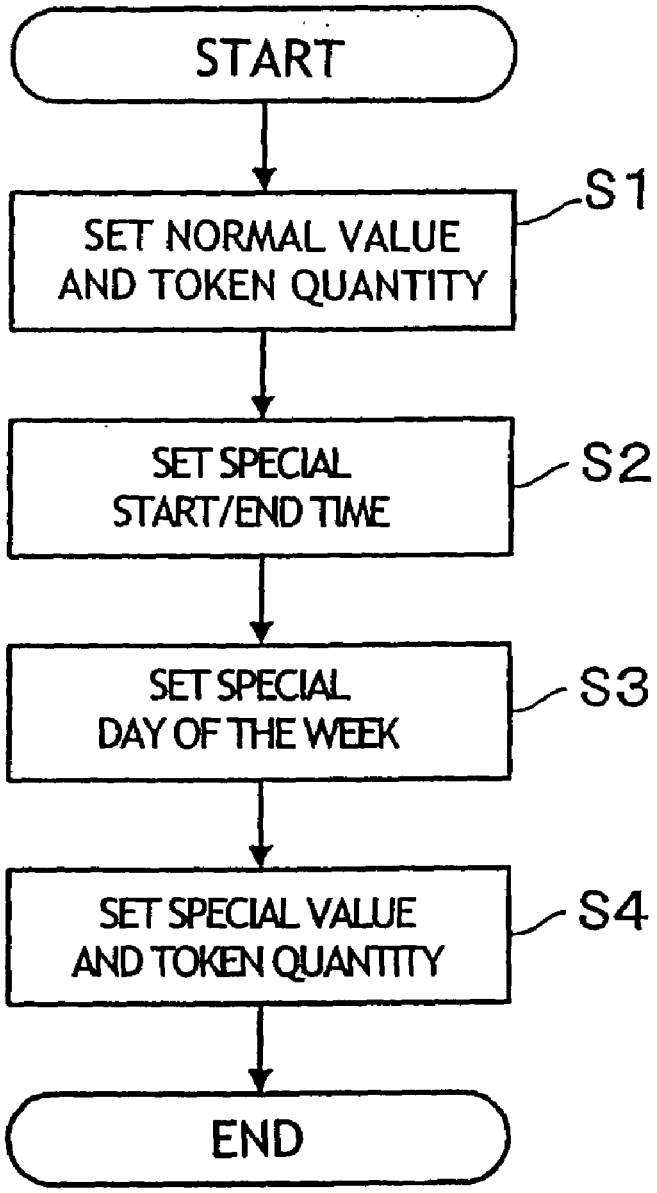
FIG. 5 is a flow diagram showing programming steps for programming the normal purchasing mode and the special purchasing mode parameters.

As shown in FIG. 5 and following a start condition, program control of the control unit 5 advances to step S1. In program step S1, the normal value and corresponding token dispensing quantity are set through the numeric keypad 7. In one example, 30 tokens can be dispensed for a value of 1000 YEN, 70 tokens can be dispensed for a value of 2000 YEN, or 120 tokens can be dispensed for a value of 3000 YEN. After step S1, program control moves to step S2.

In step S2, the starting and ending time of the special purchasing mode are set through the numeric keypad 7. For example, the starting time can be 10 AM and ending time can be 11AM. Also, the special purchasing mode starting and ending times can be set during business hours to be based on a pseudorandom number generator included within the control unit. In this way, the special purchasing mode starting and ending times are more variable. After step S2, program control moves to step S3.

In step S3, the day of the week for the special purchasing mode is set through the numeric keypad 7. For example, a day of the week for the special purchasing can be set to Sunday. This means that every Sunday a user can purchase tokens in a special purchasing mode where the user will receive a larger number of tokens for the same value of banknote accepted compared with the normal purchasing mode. The special purchasing mode day can also be set to a predetermined day of the month. For example, the 10th, 20, or 30th. After step S3, program control moves to step S4.

In step S4, the special value and corresponding token dispensing quantity are set through the numeric keypad 7. In one example, 40 tokens can be dispensed for a value of 1000 YEN, 100 tokens can be dispensed for a value of 2000 YEN, or 200 tokens can be dispensed for a value of 3000 YEN. After step S4, the programming of a value and a token quantity are completed.

Steps S2 and S3 can each be omitted. If both are omitted, the special purchasing mode is disabled, and a user can only purchase tokens in the normal purchasing mode. If step S2 is included and step S3 is omitted, then the special purchase mode is implemented every day at the time specified in step S2. If step S2 is omitted and step S3 is included the special purchasing mode will be implemented all day for the specified day of the week specified in step S3.

Figure 6:
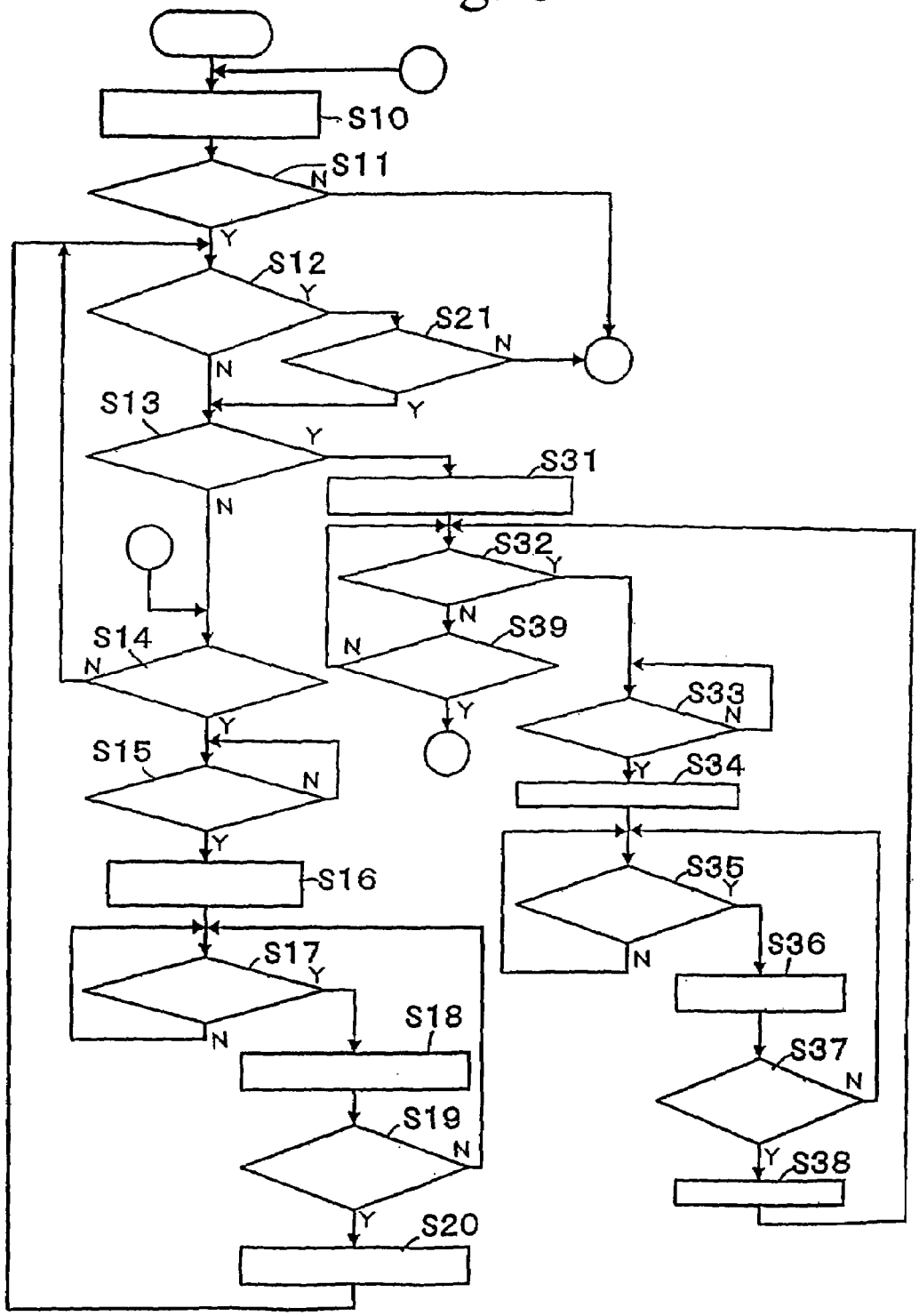
FIG. 6 is a flow diagram showing the token purchasing operation.
Figure 6A:
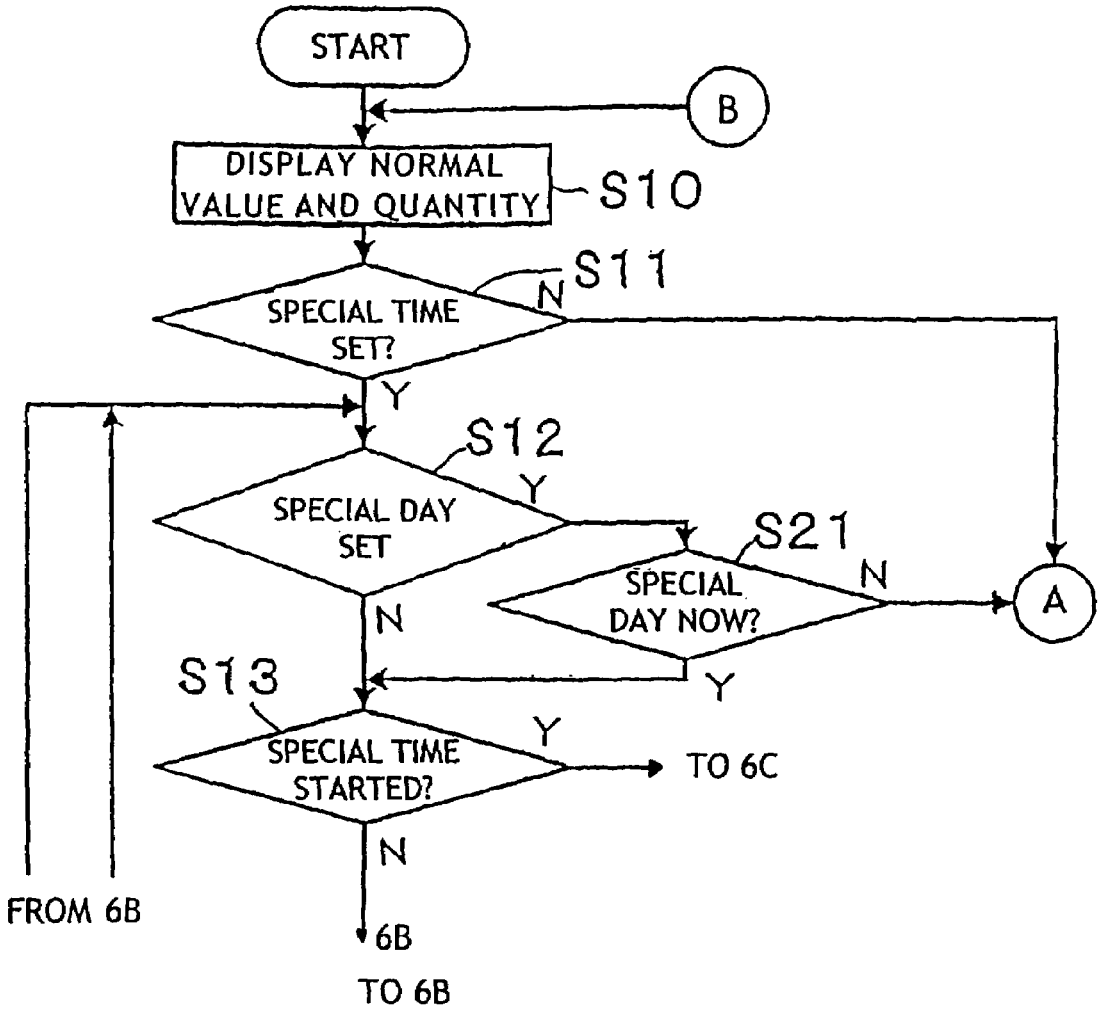
FIGS. 6A, 6B, and 6C are partitioned views of FIG. 6.
Figure 6B:
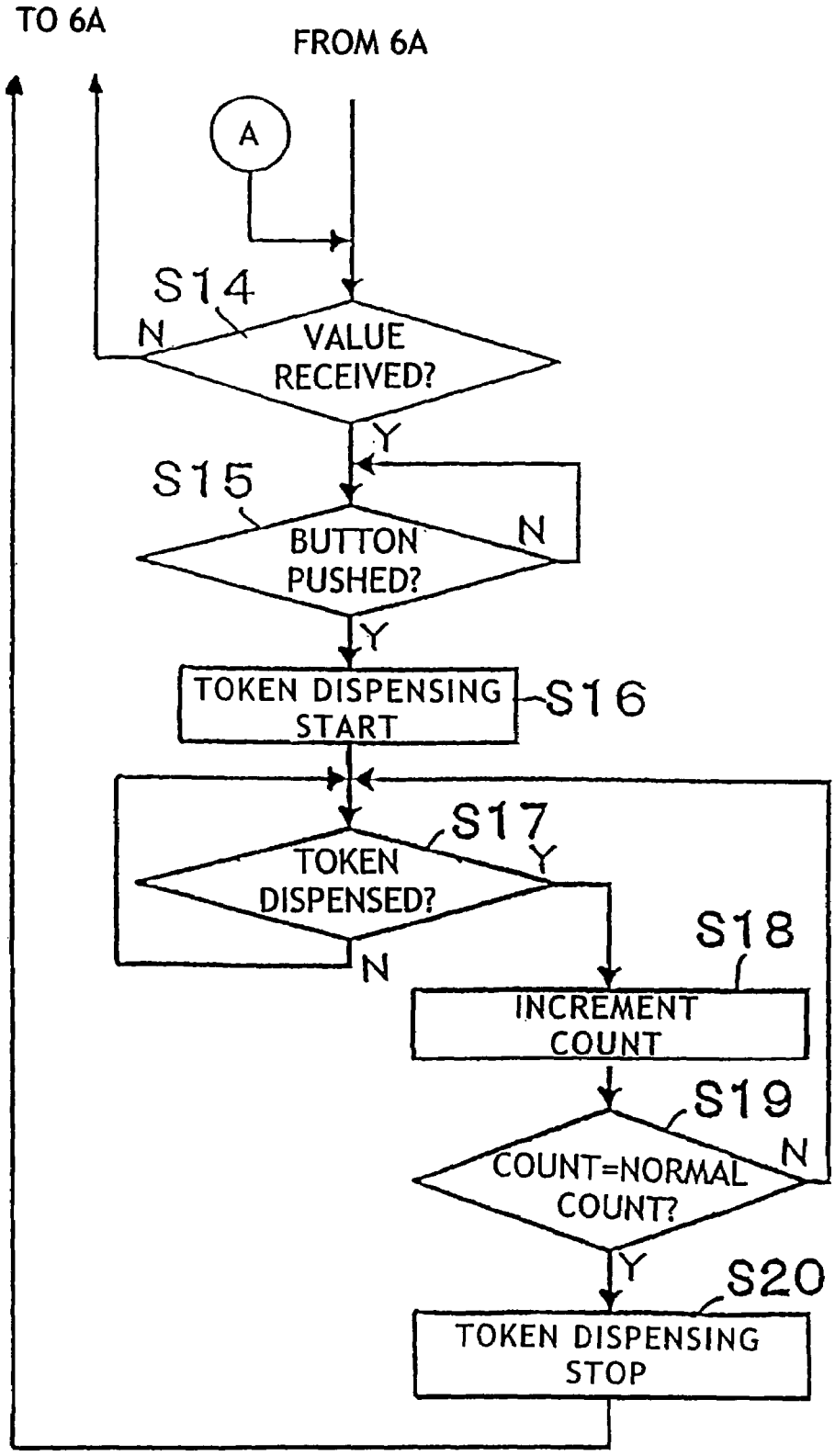
Figure 6C:
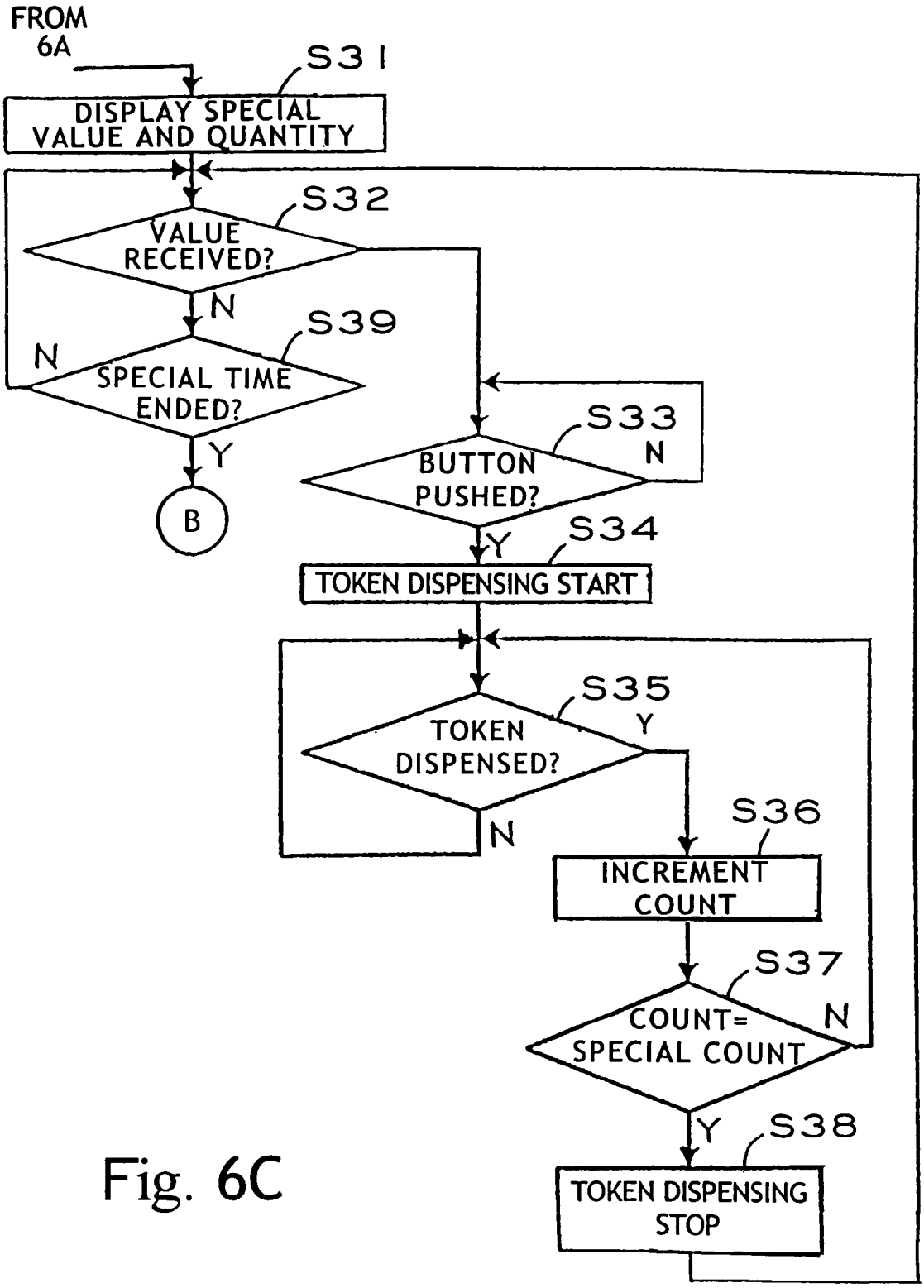

In reference to FIG. 6, the token purchasing process is illustrated. After programming the control unit in steps S1 through S4 and following a start condition, in step S10 the display 9A is updated to reflect a visual announcement that the special purchasing mode is available as shown in FIG. 4A. For example, this visual announcement can be "May I help you?" or some other message to indicate the normal purchasing mode is currently available. Display 9B is updated to reflect the value and the dispensing quantity of tokens for the normal purchasing mode. After step S10, program control moves to step S11.

In step S11, if the special purchasing mode start and end times are set, the program control moves to step S12. If the special purchasing mode start and end times are not set, the program control moves to step S14.

In step S12, if the special purchasing mode day of the week is set, the program control moves to step S21. If the special purchasing mode day of the week is not set, the program control moves to step S13. Then the current time is compared to the starting time and ending time. When the time is not the special time, program control moves to step S14.

In step S13, when the current time corresponds to the programmed special purchasing mode time, the program control moves to step S31. If the time does not correspond to the programmed special purchasing mode time, the program control moves to step S14.

In step S14, the value from the banknote accepting unit 3 and the coin accepting unit 11 are evaluated. This can occur when a banknote is inserted into the banknote accepting unit 3 or a coin is inserted into the coin accepting unit 11. If neither a banknote nor a coin has been inserted, then the program control loops back, waiting for a banknote or coin to be inserted, and program control moves to step S12. If a value is received as indicated by the banknote accepting unit 3 or the coin accepting unit 11, then program control moves to step S15.

In step S15, after a banknote or coin is accepted a button 17 push on the touch screen 10 is detected. If no button 17 push is detected, the program control waits at step S15 for the user to make a selection. Once a user has made a selection by pressing a button 17, for example by pressing button 17A, the normal purchase mode dispensing count corresponding to the button 17 pushed is set, and program control moves to step S16.

In step S16, a motor (not shown) for the token dispensing unit 4 is started so that tokens can be dispensed in a normal purchasing mode. A dispensing counter (not shown) is reset in preparation for counting the dispensed tokens. After the motor for the token dispensing unit 4 is started, program control moves to step S17.

In step S17, the control unit 5 waits for the proper number of tokens to be dispensed based on the user selection as indicated by the button 17 pushed in step S15. The control unit waits for a signal from the dispensing sensor 18 indicating a token has been dispensed from the token dispensing unit 4. After receiving a signal from the dispensing sensor 18, the program control moves to step S18.

In step S18, the dispensing counter is incremented. The count maintained by the dispensing counter indicates how many tokens have been dispensed by the token dispensing unit 4. After incrementing the dispensing counter program, control moves to step S19.

In step S19, the dispensing counter value is compared with the normal dispensing amount based on the button 17 pushed by the user in step S15. If the dispensing counter value is not equal to the normal dispensing amount based on the button 17 pushed by the user, the dispensing operation is not completed, and program control moves to step S17. If the dispensing counter value is equal to the normal dispensing amount based on the button 17 pushed by the user, the dispensing operation is completed, and program control moves to step S20.

In step S20, the token dispensing operation is completed and the motor for the token dispensing unit 4 is stopped. After the token dispensing operation is completed, program control moves to step S12.

In step S21, the programmed day of the week is compared with the current day of the week from the clock unit 13. If the current day of the week is not the programmed day of the week program control moves to step S14. If the current day of the week is the programmed day of the week program control moves to step S13.

In step S31, the display unit 9 displays the value and quantity of tokens for the special purchasing mode. Display 9A is updated to reflect a visual announcement that the special purchasing mode is available as shown in FIG. 4B. For example, this visual announcement can be "Special Purchase", "Servicing Time", or some other message to indicate the special purchasing mode is currently available. Display 9B is updated to reflect the value and the dispensing quantity of tokens for the special purchasing mode. A speaker connected to the control unit 5 can audibly announce the special purchasing mode is currently available. The audible announcement can be a voice, a tone, or a series of tones that can comprise a musical arrangement. After step S31, program control moves to step S32.

In step S32, the value from the banknote accepting unit 3 and the coin accepting unit 11 are evaluated. This can occur when a banknote is inserted into the banknote accepting unit 3 or a coin is inserted into the coin accepting unit 11. If neither a banknote nor a coin has been inserted, then the program control moves to step S39. If a value is received as indicated by the banknote accepting unit 3 or the coin accepting unit 11, then program control moves to step S33.

In step S33, after a banknote or coin is accepted, a button 17 push on the touch screen 10 is detected. If no button 17 push is detected, the program control waits at step S33 for the user to make a selection. Once a user has made a selection by pressing a button 17, for example by pressing button 17B, program control moves to step S34.

In step S34, the motor for the token dispensing unit 4 is started so that tokens can be dispensed in a special purchasing mode. The dispensing counter is reset in preparation for counting the dispensed tokens. After the motor for the token dispensing unit 4 is started program control moves to step S35.

In step S35, the control unit 5 waits for the proper number of tokens to be dispensed based on the user selection as indicated by the button 17 pushed in step S33. The control unit waits for a signal from the dispensing sensor 18 indicating a token has been dispensed from the token dispensing unit 4. After receiving a signal from the dispensing sensor 18, the program control moves to step S36.

In step S36, the dispensing counter is incremented. The count maintained by the counter indicates how many tokens have been dispensed by the token dispensing unit 4. After incrementing the dispensing counter program control moves to step S37.

In step S37, the dispensing counter value is compared with the special dispensing amount based on the button 17 pushed by the user in step S33. If the dispensing counter value is not equal to the normal dispensing amount based on the button 17 pushed by the user, the dispensing operation is not done and program control moves to step S35. If the dispensing counter value is equal to the normal dispensing amount based on the button 17 pushed by the user, the dispensing operation is done and program control moves to step S38.

In step S38, the token dispensing operation is completed and the motor for the token dispensing unit 4 is stopped. After the token dispensing operation is completed, program control moves to step S32.

At step 39, when the current time is not the ending time for the special purchasing mode, the program control moves back to step S32. When the current time has passed the programmed ending time of the special purchasing mode, the program control moves to step S10 where the display 9B is updated to reflect the value and the dispensing quantity of tokens for the normal purchasing mode.

Those skilled in the art will appreciate that various adaptations and modifications of the just-described preferred embodiment can be configured without departing from the scope and spirit of the invention. Therefore, it is to be understood that, within the scope of the amended claims, the invention may be practiced other than as specifically described herein.

What is claimed is:

1. A token purchasing device, comprising:

a banknote accepting unit for accepting banknotes and outputting a banknote value signal based on the denomination of the accepted banknote;

a clock unit for outputting the current time information;

a pseudorandom number generator for indicating a predetermined range of times from a start time to an end time;

a control unit for receiving the banknote value signal from the banknote accepting unit and the current time information from the clock unit, the control unit storing a predetermined range of times from a start time to an end time, the control unit computing and outputting a token dispensing signal corresponding to a predetermined quantity of tokens, the predetermined quantity of tokens being a first quantity of tokens when the current time is within the predetermined range of times, the predetermined quantity of tokens being a second quantity of tokens when the current time is not within the predetermined range of times, the first quantity of tokens being greater than the second quantity of tokens; and a token dispensing unit for dispensing the predetermined quantity of tokens based on the token dispensing signal from the control unit, wherein the token dispensing signal is automatically changed based on the current time information from the clock unit.

2. The token purchasing device of claim 1, wherein the clock unit includes current date information and current hour information, and wherein the control unit stores a predetermined day information and predetermined hour information, the token dispensing signal being automatically changed based on the current day and current hour information.

3. The token purchasing device of claim 1, further comprising:

a display unit for displaying the current purchasing mode and user selections, the display unit receiving signals from the control unit; and a touch screen unit for receiving a command from a user, the command from the user indicating the quantity of tokens purchased in the current purchasing mode, the touch screen unit outputting the command from the user to the control unit.

4. The token purchasing device of claim 1, further comprising:

a speaker connected to the control unit, the speaker for emitting an audible announcement, the audible announcement being an indication of the availability of a special purchasing mode, wherein a user can purchase a greater quantity of tokens for a predetermined banknote value during the special purchasing mode than during a time period when the special purchasing mode is inoperative.

5. The token purchasing device of claim 1, further comprising:

a coin dispensing unit for dispensing coins, wherein the coin dispenser can dispense a predetermined quantity of coins with a value corresponding to the difference between the value of the banknote accepted and the value of the quantity of tokens dispensed.

6. The token purchasing device of claim 1, further comprising:

a smart card accepting unit for accepting a smart card, the smart card conveying a predetermined value, the smart card accepting unit reading the value from the smart card and outputting a smart card value signal, wherein the control unit receives the smart card value signal from the smart card accepting unit, the control unit computing a token dispensing signal corresponding to a predetermined quantity of tokens.

7. The token purchasing device of claim 3, wherein the touch screen unit is in a plane parallel to and overlapping a predetermined portion of the display unit.

8. The token purchasing device of claim 3, wherein the display unit is a liquid crystal display, a cathode ray tube, a fluorescent character display tube, or a plasma display panel.

* * * * *